United States Patent [19]

Dokoupil

[11] 4,051,700

[45] Oct. 4, 1977

[54] PROCESSING OF LEATHER

[75] Inventor: Jiri Dokoupil, Guckingen, Germany

[73] Assignee: Maschinenfabrik Turner GmbH, Oberursel, Germany

[21] Appl. No.: 746,329

[22] Filed: Dec. 1, 1976

[51] Int. Cl.[2] ..... C14B 1/40

[52] U.S. Cl. ..... 69/33

[58] Field of Search ..... 69/33, 34

[56] References Cited

U.S. PATENT DOCUMENTS

| | | | |
|---|---|---|---|
| 73,408 | 1/1868 | Tidd | 69/33 |
| 3,398,557 | 8/1968 | Dokoupil et al. | 69/33 |
| 3,677,041 | 7/1972 | Dokoupil | 69/33 |

FOREIGN PATENT DOCUMENTS

| | | | |
|---|---|---|---|
| 813,060 | 5/1969 | Canada | 69/33 |
| 859,991 | 1/1971 | Canada | 69/33 |
| 1,914,910 | 10/1970 | Germany | 69/33 |
| 1,914,964 | 3/1969 | Germany | 69/33 |
| 1,914,965 | 3/1969 | Germany | 69/33 |
| 43-5675 | 3/1968 | Japan | 69/33 |
| 1,448,355 | 9/1976 | United Kingdom | 69/33 |

*Primary Examiner*—Alfred R. Guest

*Attorney, Agent, or Firm*—Donald N. Halgren; Richard B. Megley; Vincent A. White

[57] ABSTRACT

This invention relates to machines for softening leather, commonly referred to as staking machines, of the type in which leather to be staked is passed between opposed interengageable processing elements the distance between which is periodically increased and decreased by relative movement of the processing elements. The leather is staked by the action of the processing elements as they approach their minimum distance apart. The construction of the machine is such that the processing elements both execute a periodic motion around closed paths e.g. circular paths. The movements of the two processing elements around their closed paths are mechanically synchronized. Thus, the leather is processed and is simultaneously transported by the movement of the processing elements.

2 Claims, 2 Drawing Figures

PROCESSING OF LEATHER

BACKGROUND OF THE INVENTION

Leather, in the course of manufacture, is subjected to various processes to produce leather of an acceptable quality. Among the processes are those for the softening and stretching of leather: so called staking processes. It has been proposed to effect processing of leather, for example staking, by means of two, opposed processing elements between which the leather is through-fed and whose distance apart is increased and decreased periodically by relative movement. The operation of this so-called vibration-type staking equipment has been known for a long time, see for example U.S. Pat. No. 73408 (Tidd) dated Jan. 14, 1868.

More recent work in this field has been concerned with the means by which the material to be processed is transported through the working-zone of the vibration-type staking machine. It has been proposed to provide a vibration-type staking machine having processing elements or tools with projections which interengage in the operation of the machine, in which the leather is fed through the working gap between the tools by means of two elastic conveyor-belts; such a machine is described in German Auslegeschrift No. 1285092 (Strojosvit, Narodni Podnik) dated June 25, 1962 and machines similar to that described in the Auslegeschrift have been used in large numbers.

It has also been proposed to transport the material through the vibration zone by means of an air current, see for example German Patent Application Nos. P 19 14 910.1, P 19 14 964.5, and P 19 14 965.6. However, transportation of the leather through the vibration zone by means of an air current has not proved practical.

It has also been proposed in German Patent Application No. P 22 45 008.4 (Badische Maschinenfabrik GmbH) dated Sept. 14, 1972 to provide a machine having processing tools with projections, one of the tools being fixed in a closed position in the operation of the machine and the other of the tools oscillating, the leather being simply drawn out from between the tools as the said other tool oscillates. To introduce the leather into such a machine the tool which is fixed in a closed position whilst the leather is being processed, is moved to an open position in which it is spaced from the other of the tools: thus machines working on this principle have no conveyor belts. Such machines are used in the trade, however they are not through-feed machines and thus cannot carry out a continuous-processing operation.

SUMMARY OF THE INVENTION

The invention provides a machine for the processing of flat, flexible objects, especially for softening, stretching and glazing of leather comprising two opposed interengageable processing elements between which the objects are through-fed for processing, the elements being mounted for movement around closed paths (for example circular paths) and the elements being arranged so that their paths overlap, and means for moving the elements correspondingly around their closed paths with a periodic motion whereby the distance apart of the elements is periodically increased and decreased so that the object to be processed during the phase of motion in which the paths of the elements overlap (and the elements are interengaged) and the object is simultaneously transported through the machine by the elements, the elements having a component of motion in the through-feed direction during the phase of motion in which the paths of the elements overlap.

A preferred embodiment of the machine comprises mechanical means, for example a toothed belt, by which the motion of the elements around their closed paths is synchronised, the motion of the elements around their paths being in opposite rotational directions.

Transport of an object to be processed is thus achieved by means which has not hitherto been used on machines for processing flat, flexible objects using oscillating processing tools. Thus the oscillating tools in a machine according to the invention not only have the function of processing but also simultaneously carry out the transporting function, and conveyor belts are thus not required. Hitherto, oscillating tools have executed movements on a straight or nearly-straight path; in a machine according to the invention each tool executes a periodic motion around an associated closed path with which motion it is possible simultaneously to process the leather (with the overlapping of the paths of the two tools) and to transport it by the component of the motion of the elements which is in the direction of transport.

BRIEF DESCRIPTION OF THE DRAWINGS

The above and other features of the invention will become more clear from the following description of a staking machine, to be read with reference to the accompanying drawings. It will be realised that this staking machine has been selected for description to illustrate the invention by way of example and not of limitation of the invention.

In the accompanying drawings.

DESCRIPTION OF THE ILLUSTRATIVE MACHINE

Figure 1:
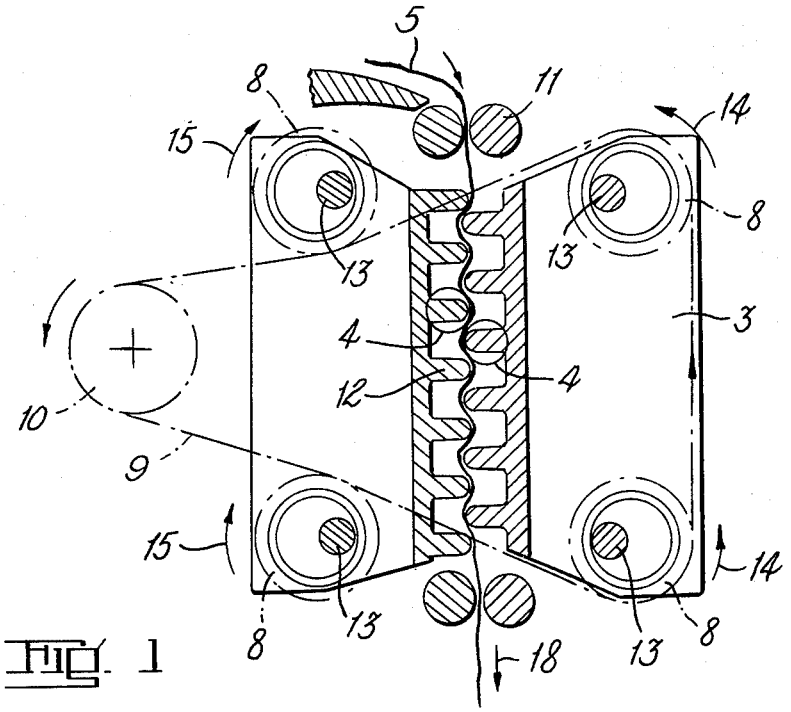
FIG. 1 is a diagrammatic side view partly in section showing the illustrative staking machine.

The illustrative staking machine comprises two opposed, interengageable processing elements, namely processing tools 2,3, each mounted for translational movement around a closed, circular path. Each of the processing tools 2,3 comprises a number of projections 12 arranged so that the projections 12 of the tool 2 are in alignment with spaces between the projections 12 of the tool 3.

The illustrative machine comprises four eccentric mechanisms 13, two of the mechanisms 13 being associated with each of the processing elements 2,3. The motion of the elements 2,3 around their closed paths is brought about by the eccentric mechanisms 13, the mechanisms 13 associated with one of the tools 2 being rotated in the opposite direction to the eccentric mechanisms 13 associated with the other of the tools 3. The eccentric mechanisms are driven by a toothed belt 9 which passes toothed wheels 8 of the eccentric mechanisms 13. The belt 9 passes round a pulley 10 of a motor (not shown) by which the belt is driven to drive the eccentric mechanisms 13. The toothed belt 9 ensures that the eccentric mechanisms 13 are driven in synchronism and means are thus provided whereby the tools 2,3 are moved correspondingly around their closed paths with a periodic motion.

The tools 2,3 are mounted so that the closed paths of the tools 2,3 overlap. As the tools are moved around their closed paths with the periodic motion, the distance apart of the tools thus periodically increases and decreases so that the projectons 12 of one tool 2 interengage or mesh between the projections 12 of the other tool 3 during the phase of motion in which the paths overlap; because the tools are always moved in synchronism by the belt 9 there is no risk of the projections on one of the tools fouling the projections on the other tool. Leather 5 to be processed is processed by the processing tools 2,3 during the phase of movement of the tools in which the paths of the tools overlap; thus the leather 5 is engaged by and worked by the projections as can be seen from the drawings. During the phase in which the paths of the tools 2,3 overlap, the tools 2,3 also have a component of motion in the through-feed direction 18 of the machine and thus as the tools 2,3 process the leather 5, the leather 5 is simultaneously fed through the machine in the direction 18 by the tools. The arrows 14 indicate the direction of motion of the tool 3 around its closed path and the arrows 15 indicate the direction of motion of the tool 2 around its closed path.

Figure 2:
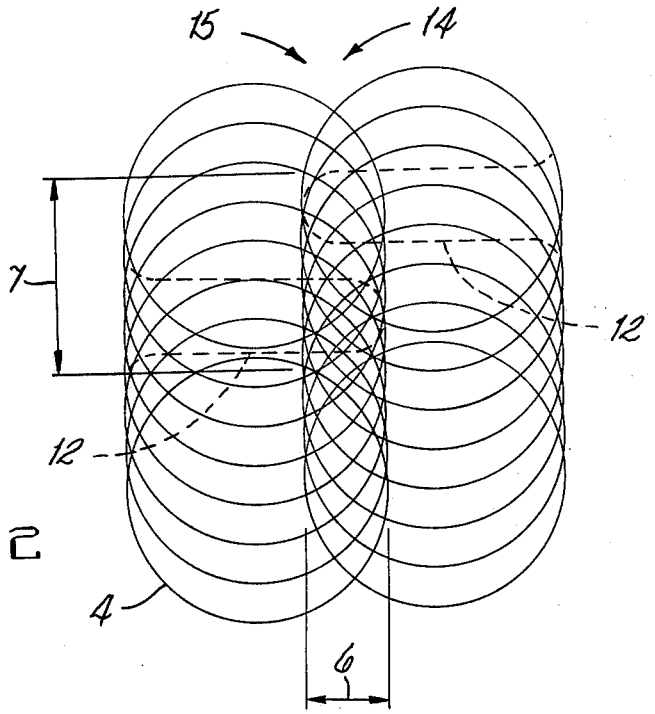
FIG. 2 is a diagrammatic view showing the motion of a projection of a processing element of the machine shown in FIG. 1.

The movements of a number of the projections 12 of the tools 2,3 are shown, enlarged, in FIG. 2. Two projections 12 are shown in FIG. 2 (one from each of the tools 2,3) at the closest distance of approach of the tools and the degree of interengagement of the projections 12 is indicated by the arrow 6. The distance by which the leather 5 is simultaneously transported during the cycle of movement of the tools 2,3 is indicated by the arrow 7.

In the illustrative machine the transporting of the leather 5 is effected by the processing tools 2,3 themselves and this lends itself to construction of through feed machines. In the illustrative machine it is possible to positively influence the through-feed of the leather, for example by braking, e.g., using rolls 11, thus to obtain some relative motion between the tools and the surface of the leather in the direction 18 of the through-feed, and hence to achieve other processing effects (for example smoothing and glazing effects).

Having described the invention, what I claim as new and desire to secure by Letters Patent of the United States is:

1. A machine for the processing of flat, flexible objects, especially for the softening, stretching and glazing of leather; said machine comprising two opposed interengageably processing elements between which the objects are through-fed for processing, both the opposed processing elements being mounted for movement around closed circular paths and the processing elements being arranged so that their paths overlap, and at least a pair of eccentric mechanisms for moving each of the processing elements correspondingly around their closed circular paths with a periodic motion whereby the distance apart of the processing elements is periodically increased and decreased so that the object to be processed is processed during the phase of motion in which the paths of the processing elements interengage and overlap and the object is simultaneously transported through the machine by the processing elements, the processing elements having a component of motion in the through-feed direction during the phase of motion in which the paths of the processing elements overlap.

2. A machine according to claim 1 wherein the motion of the processing elements along their closed circular paths occurs in opposite rotational directions.

* * * * *